US007319360B2

(12) United States Patent
Gan et al.

(10) Patent No.: US 7,319,360 B2
(45) Date of Patent: Jan. 15, 2008

(54) MODULATOR

(75) Inventors: Wee-Kuan Gan, Taipei (TW); Chih-Jen Hsu, Taipei (TW)

(73) Assignee: Phison Electronics Corp., Hsinchu (TW)

( * ) Notice: Subject to any disclaimer, the term of this patent is extended or adjusted under 35 U.S.C. 154(b) by 64 days.

(21) Appl. No.: 11/163,729

(22) Filed: Oct. 28, 2005

(65) Prior Publication Data

US 2006/0267673 A1 Nov. 30, 2006

(51) Int. Cl.
*G05F 1/10* (2006.01)
*G05F 3/02* (2006.01)

(52) U.S. Cl. ..... 327/541

(58) Field of Classification Search ..... 327/538, 327/540–541, 543
See application file for complete search history.

(56) References Cited

U.S. PATENT DOCUMENTS 5,689,460 A * 11/1997 Ooishi ..... 365/189.07
5,945,819 A * 8/1999 Ursino et al. ..... 323/282
6,529,563 B1 * 3/2003 Mosinskis et al. ..... 375/317
2003/0090251 A1 * 5/2003 Nakashimo ..... 323/280

* cited by examiner

*Primary Examiner*—Quan Tra
(74) *Attorney, Agent, or Firm*—Jianq Chyun IP Office

(57) ABSTRACT

The present invention describes a modulator including a differential amplifier connected to a reference voltage and a first transistor, and the first transistor is connected to a feedback device, and a second transistor is set between the first transistor and the differential amplifier and connected to a voltage detector and a diode, and the diode is connected to a power supply, and the voltage detector keeps on detecting an output voltage (VOUT) between the feedback device and the first transistor. If the output voltage (VOUT) value is lower than a predetermined voltage value of the power supply, the voltage detector will issue a signal to drive the second transistor and limit a gate-source voltage (VGS) of the first transistor within a voltage difference of the diode, so as to reduce the impetus of the first transistor and avoid the phenomenon of a sudden climb with an excessively large output voltage (VOUT).

4 Claims, 6 Drawing Sheets

MODULATOR

This application claims the priority benefit of Taiwan patent application number 094117924 filed on May 31, 2005.

BACKGROUND OF THE INVENTION

1. Field of the Invention

The present invention relates to a modulator, and more particularly to a modulator that uses a detector to detect the voltage between a feedback device and a first transistor, so as to reduce any excessively high output voltage resulted from plugging/unplugging or suddenly starting a load device.

2. Description of Related Art

As mobile electronic technologies are increasingly advancing, electronic products such as note book, PDA, mobile phones and digital cameras are extensively used, and the functions of these products are increased. Therefore, more power consumption is required by a system, and thus many ways of reducing power consumption during an idle time or in a sleep mode is introduced. If an idle mode is switched to an operating mode, the system will need to start or turn on a feedback device. Attentions should be paid to a sudden climb of an output voltage (VOUT) to prevent its load device from being damaged by an excessively high output voltage. Besides, it is necessary for an idle system to minimize the power consumption of a battery; therefore the way of designing an efficient power management system is an important subject to most designers and developers.

Referring to FIG. 1, related components will be illustrated below, but other components are well known by the persons skilled in the art and thus will not be described here. The description below is given as illustrations and is not intended to limit the present invention. In FIG. 1, the prior art modulator comprises a differential amplifier A connected to a PMOS transistor B; a source pole B1 of the PMOS transistor B provided for receiving power; a drain pole B2 of the PMOS transistor B provided for connecting a feedback device C; a voltage divider node D of the feedback device C connected to a load voltage input terminal A1 of the differential amplifier A; and an reference voltage input terminal A2 of the differential amplifier A for inputting a reference voltage.

When the system starts operating, output voltage (VOUT) is started from a ground potential. The ground potential will be pulled-up rapidly due to the effect of the feedback circuit to increase the impetus of the PMOS transistor B. Therefore, the feedback device C will instantly climb to the power supply voltage (VCCAH) and produce an excessively high output voltage, and such phenomenon will cause damages to an output load device (such as a flash memory).

SUMMARY OF THE INVENTION

The present invention has been accomplished under the circumstances in view.

According to one aspect of the present invention, the modulator uses a second transistor connected between a differential amplifier and a first transistor and a voltage detector connected to the second transistor for detecting output voltage (VOUT). If the output voltage (VOUT) value is lower than a predetermined voltage value, the second transistor will limit a gate-source voltage (VGS) of the first transistor within a voltage difference of a diode to lower the impetus of the first transistor and reduce a sudden rise of the output voltage (VOUT), so as to assure a stable operation of a load device.

According to another aspect of the present invention, the modulator uses a third transistor connected between an output voltage (VOUT) and a reference voltage. If an output load is increased suddenly to pull down the output voltage (VOUT), a gate-source voltage (VGS) of the third transistor will be increased immediately to provide current required by a load device, so as to prevent a delay of the differential amplifier. If the system enters into an idle mode, the differential amplifier and the feedback device will be closed, and only the third transistor will remain, and thus can greatly reduce the power required.

BRIEF DESCRIPTION OF THE DRAWINGS

FIG. 3 is a voltage comparison chart according to the present invention and the prior art when the modulator is turned on.

DETAILED DESCRIPTION OF THE PREFERRED EMBODIMENTS

Figure 2:
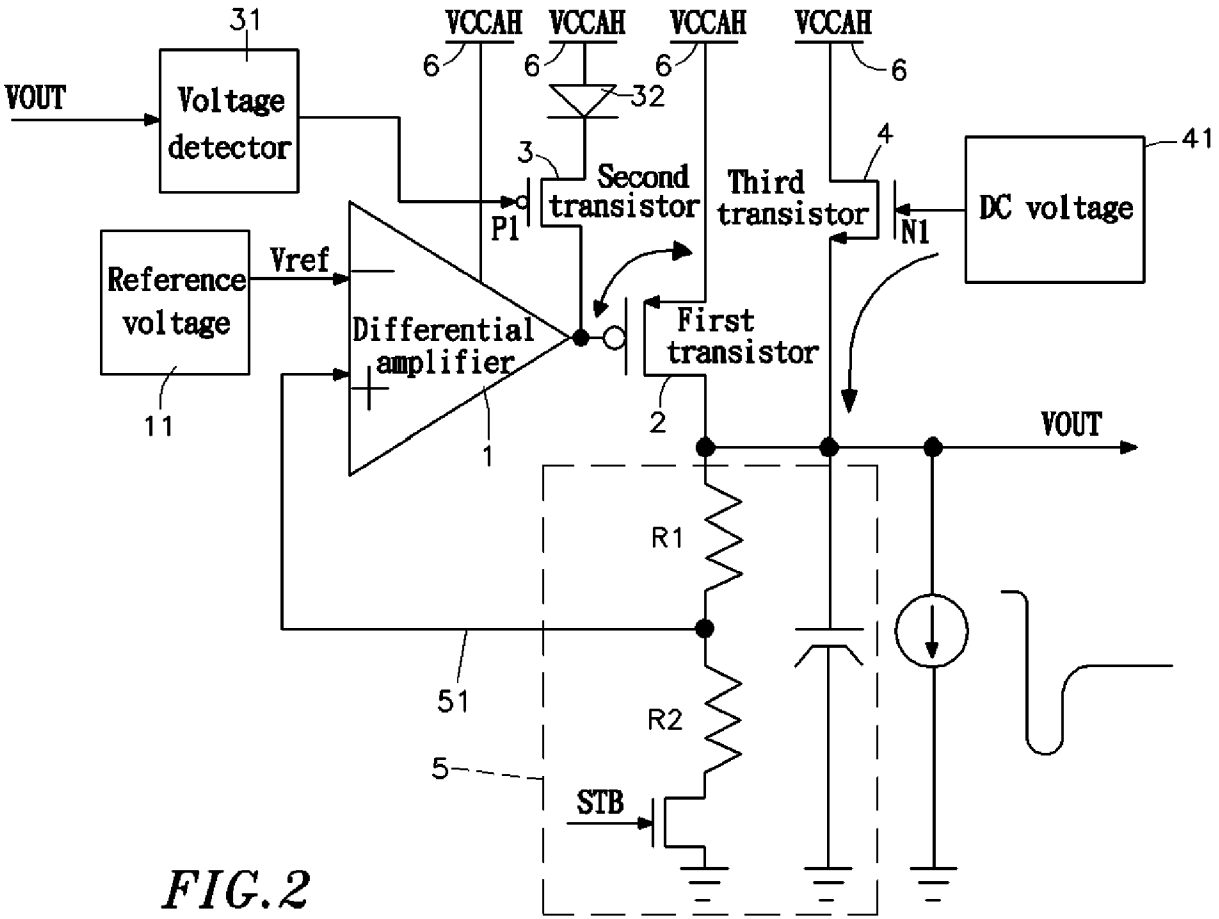
FIG. 2 is a schematic circuit diagram of a modulator according to the present invention.

Referring to FIG. 2, the modulator in accordance with the present invention is shown comprising a differential amplifier 1, a first transistor 2, a second transistor 3, a third transistor 4, a feedback device 5 and a plurality of power supply 6.

The differential amplifier 1 is connected to the power supply 6, and the differential amplifier 1 inputs a reference voltage 11 and a feedback voltage 51 outputted from the feedback device 5. If the feedback voltage 51 is lower than the reference voltage 11, the differential amplifier 1 will output a low level signal to the first transistor 2. If the feedback voltage 51 is higher than the reference voltage 11, the differential amplifier 1 will output a high level signal to the first transistor 2.

The first transistor 2 is connected to the feedback device 5 and the power supply 6, and the first transistor 2 receives the low level signal and the high level signal transmitted from the differential amplifier 1.

The second transistor 3 is connected to a voltage detector 31 and a diode 32, and the voltage detector 31 is connected to an output voltage (VOUT), and the diode 32 is connected to the power supply 6, and the second transistor 3 is set between the differential amplifier 1 and the first transistor 2.

The third transistor 4 is connected to a DC voltage 41, and the third transistor 4 is set between the power supply 6 and the feedback device 5.

The feedback device 5 is connected to the first transistor 2.

If the feedback voltage 51 received by the differential amplifier 1 is lower than the reference voltage 11, a low level signal will be sent to the first transistor 2, and then the first transistor 2 will be enabled to drive the power supply 6 to supply an output current (VOUT) through the first transistor 2. In the meantime, the voltage detector 31 will continue detecting the output voltage (VOUT). If the output voltage (VOUT) value is lower than a predetermined voltage value, the voltage detector 31 will issue a signal to drive the second transistor 3 such that a gate-source voltage (VGS) of the first transistor 2 is limited within a voltage difference of the diode 32. Such arrangement can lower the impetus of the first transistor 2 and reduce a sudden pull of the output voltage (VOUT) to prevent an output load from being damaged.

If the voltage value of the DC voltage 41 connected to the third transistor 4 is higher than the output voltage (VOUT) value between the first transistor 2 and the feedback device 5 and a gate-source voltage (VGS) of the third transistor 4 is smaller than a threshold voltage (VTH) to keep the normal operation of the modulator, the third transistor 4 will not supply current to the feedback device 5. If the output voltage (VOUT) is pulled down instantly, the gate-source voltage (VGS) of the third transistor 4 will be increased to directly supply the current to the feedback device 5 without going through a feedback circuit of the feedback device 5 and the differential amplifier 1 to prevent any delay and maintain the instant operation of the system. If the system enters into an idle mode (or sleep mode), the system only maintains the operation of the simple logic circuits, and thus the modulator can accept a larger tolerance of the output voltage (VOUT) and stop the operation of the resistors of the differential amplifier 1 and the feedback device 5. Only the DC voltage 41 is remained to maintain the normal operation of the third transistor 4, and thus the invention can greatly lower the power required for the idle mode.

Further, the voltage value detected by the voltage detector 31 can be set to a predetermined value for comparisons. If the voltage detected by the voltage detector 31 is lower than the predetermined value, the voltage detector 31 will issue a signal to drive the second transistor 3 and assure the stable operation of the system.

Further, the first transistor 2 and second transistor 3 could be PMOS transistors and the third transistor 4 could be a NMOS transistor.

Figure 1:
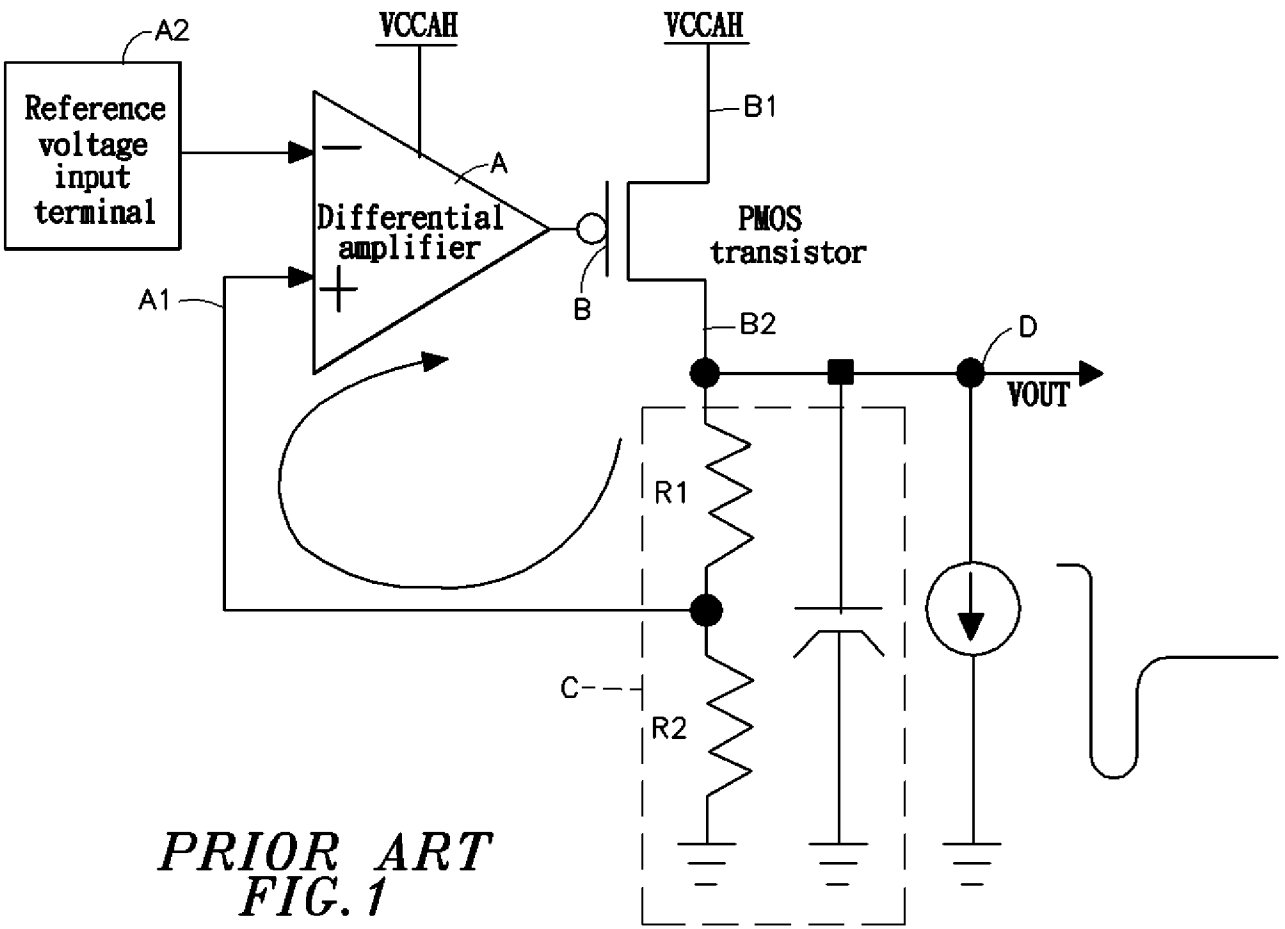
PRIOR ART FIG. 1
FIG. 1 is a schematic circuit diagram of a prior art modulator installed in an electronic product system.
Figure 3:
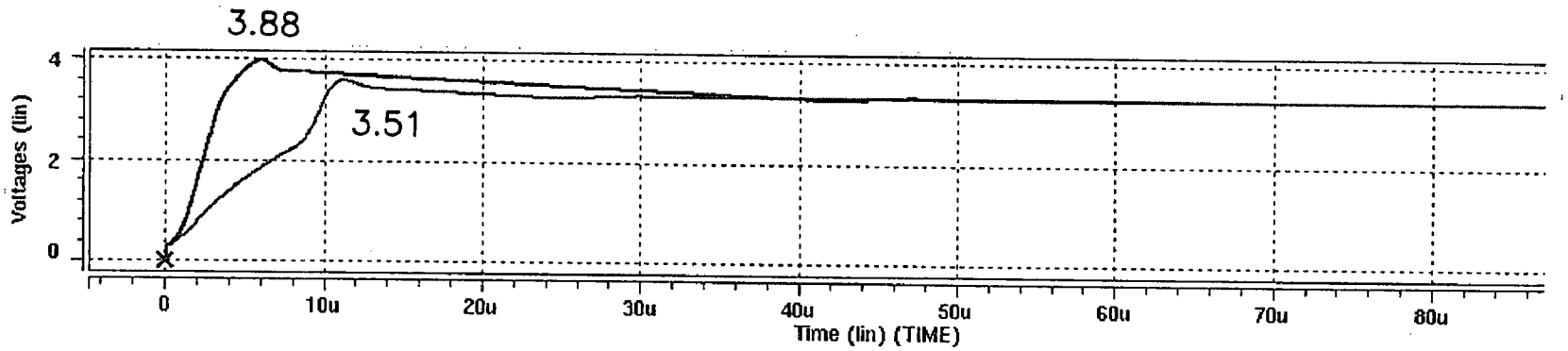

Referring to FIGS. 1 to 3, the feedback device 5 uses a 1 μF load capacitor to simulate the voltage and current curves of the actual operation. In FIG. 3, the prior art modulator has no diode 32 for its protection and the peak value of the output voltage (VOUT) can reach 3.88V. The present invention uses the second transistor 3 to limit the gate-source voltage (VGS) of the first transistor 2 within the voltage difference of the diode 32, and thus the peak value of its output voltage can be greatly reduced to 3.51V, so as to prevent the feedback device 5 from being damaged when receiving an excessively high output voltage.

Figure 4:
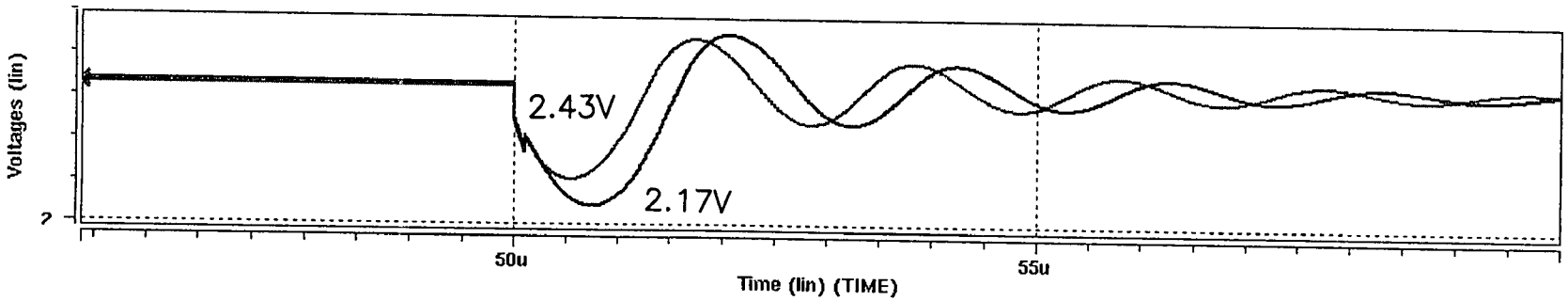
FIG. 4 is a voltage comparison chart according to present the invention and the prior art when the modulator instantly requires a larger current.

Referring to FIGS. 1, 2 and 4, the prior art modulator does not set the third transistor 4 and the DC voltage 41, and thus if the output VOUT instantly draws a large quantity of current, its minimum voltage will drop to 2.17V. If the feedback device 5 of the present invention draws a large quantity of current, its minimum voltage only drops to 2.43V, and the dropping waveform explains that the first transistor 2 needs to drive by the feedback differential amplifier, and thus the response speed of the third transistor 4 is faster than that of the first transistor 2.

Figure 5A:
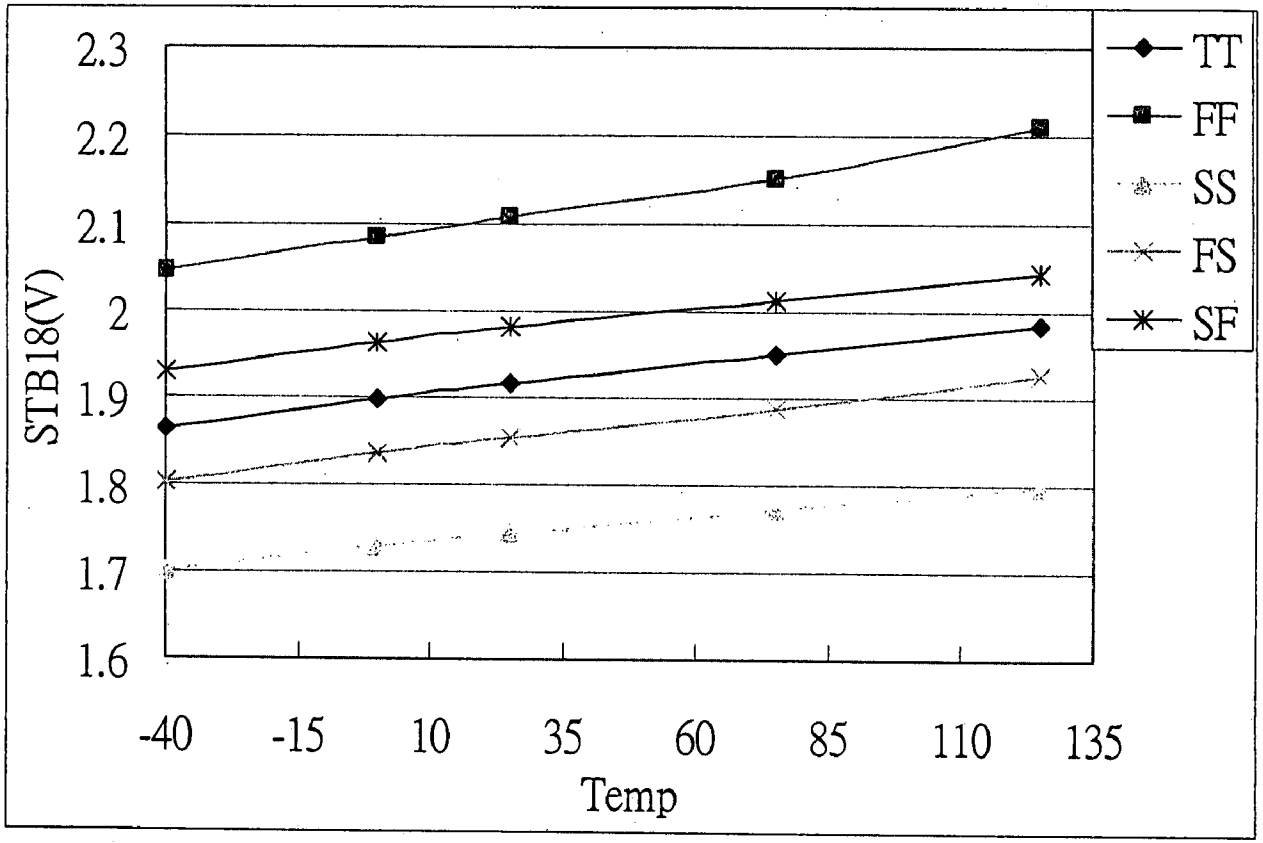
FIG. 5A is a chart of the voltage of an idle mode without any load according to the present invention.
Figure 5B:
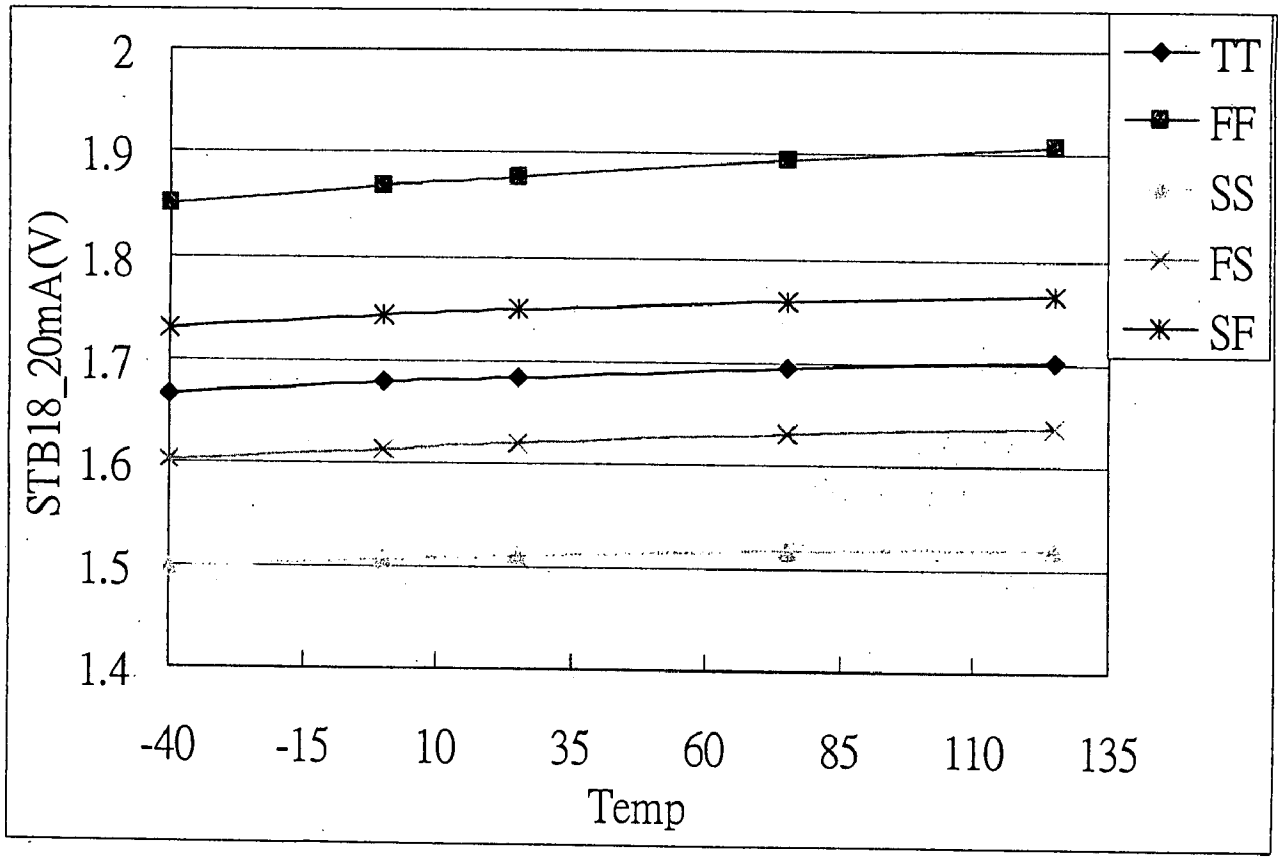
FIG. 5B is a chart of the voltage of an idle mode with a load according to present the invention.

Refer to FIGS. 5A and 5B, the system enters into an idle mode, the source voltage of third transistor 4 under the manufacturing process and temperature change still remains at an acceptable range of 1.5V~2.21V even if the current load from zero up to 20 mA, and the overall power consumption at the idle mode is greatly reduced to several μA, so as to greatly extend the idle time of the system.

The modulator of the present invention improves over the prior art as follows.

1. The present invention adopts the second transistor set between the differential amplifier and the first transistor, and the second transistor connected to a voltage detector to detect the output voltage (VOUT) between the feedback device and the first transistor. If the output voltage (VOUT) value is lower than a predetermined voltage value, the second transistor will limit the gate-source voltage (VGS) of the first transistor within the voltage difference of the diode to lower the impetus of the first transistor and reduce the excessively high output voltage to prevent the feedback device from being damaged by an excessively high voltage.

2. The present invention adopts the third transistor set between the feedback device and the first transistor and the third transistor connected to the DC voltage. If the output voltage (VOUT) between the first transistor and the feedback device is pulled down instantly, the gate-source voltage (VGS) of the third transistor will directly supply a current to the feedback device without going through the circuit response of the differential amplifier and the feedback device, so as to prevent a delay. If the system enters into an idle mode, the operation of the resistors installed in the differential amplifier and the feedback device will be stopped. Only the DC voltage is remained to keep the normal operation of the third transistor, and thus the invention can greatly reduce the power required for the idle mode.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A modulator, comprising:

a power supply;

a feedback device;

a differential amplifier, coupled to said power supply for inputting a reference voltage and a feedback voltage outputted from said feedback device, and if said feedback voltage is lower than said reference voltage, said differential amplifier will output a low level signal, and if said feedback voltage is higher than said reference voltage, said differential amplifier will output a high level signal;

a first transistor, coupled to said feedback device and said power supply for receiving said low level signal and said high level signal transmitted from said differential amplifier, and if said low level signal is received, then said first transistor will be electrically connected and supply a power to said feedback device; and a second transistor, connected to a voltage detector and a diode, and said voltage detector being coupled to an output voltage (VOUT), and said diode being coupled to said power supply, and said second transistor being set between said differential amplifier and said first transistor, and said voltage detector continues detecting the output voltage (VOUT) between said feedback device and said first transistor; wherein if said output voltage (VOUT) value is lower than a predetermined voltage value, then said voltage detector will issue a signal to drive said second transistor to limit a gate-source voltage (VGS) of said first transistor within a voltage difference of said diode, so as to lower the impetus of said first transistor and reduce a sudden climb with an excessively high output voltage.

2. The modulator as claimed in claim 1, wherein said first transistor and said second transistor are PMOS transistors.

3. The modulator as claimed in claim 1, further comprising a third transistor coupled to said power supply, said feedback device and said first transistor, and said third transistor is coupled to a DC voltage.

4. The modulator as claimed in claim 3, wherein said third transistor is a NMOS transistor.

* * * * *